US008562412B2

(12) United States Patent
Matsuno

(10) Patent No.: US 8,562,412 B2
(45) Date of Patent: Oct. 22, 2013

(54) ROULETTE GAME SYSTEMS AND ROULETTE GAME APPARATUS

(75) Inventor: Masaki Matsuno, Kanagawa (JP)

(73) Assignee: Juno Gaming Co., Ltd., Kanagawa (JP)

( * ) Notice: Subject to any disclaimer, the term of this patent is extended or adjusted under 35 U.S.C. 154(b) by 0 days.

(21) Appl. No.: 13/497,820

(22) PCT Filed: Sep. 24, 2010

(86) PCT No.: PCT/JP2010/066507

§ 371 (c)(1),
(2), (4) Date: Apr. 17, 2012

(87) PCT Pub. No.: WO2011/037165

PCT Pub. Date: Mar. 31, 2011

(65) Prior Publication Data

US 2012/0202575 A1 Aug. 9, 2012

(30) Foreign Application Priority Data

Sep. 28, 2009 (JP) ..... 2009-223030

(51) Int. Cl.
*A63F 5/00* (2006.01)

(52) U.S. Cl.
USPC .. 463/17; 273/142 E; 273/142 H; 273/143 R; 463/19

(58) Field of Classification Search
USPC ..... 463/17, 19; 273/142 E, 142 H, 142 R
See application file for complete search history.

(56) References Cited

U.S. PATENT DOCUMENTS

| | | | | | |
|---|---|---|---|---|---|
| 3,853,324 | A * | 12/1974 | Reiner et al. | ..... | 273/142 E |
| 5,088,737 | A | 2/1992 | Frank et al. | | |
| 5,639,089 | A * | 6/1997 | Matsumoto et al. | ..... | 273/142 E |
| 5,879,235 | A * | 3/1999 | Kaneko et al. | ..... | 463/34 |
| 6,164,646 | A * | 12/2000 | Uehara et al. | ..... | 273/142 R |
| 6,164,647 | A * | 12/2000 | Chee | ..... | 273/142 R |
| 6,186,892 | B1 * | 2/2001 | Frank et al. | ..... | 463/19 |
| 6,461,241 | B1 * | 10/2002 | Webb et al. | ..... | 463/20 |
| 6,764,398 | B2 * | 7/2004 | Stone et al. | ..... | 463/25 |
| 6,824,463 | B1 * | 11/2004 | Yamaguchi et al. | ..... | 463/17 |
| 7,311,305 | B2 * | 12/2007 | Matsuno et al. | ..... | 273/142 E |
| 7,694,971 | B2 * | 4/2010 | Sorge | ..... | 273/274 |
| 7,926,810 | B2 * | 4/2011 | Fisher et al. | ..... | 273/274 |
| 8,113,516 | B2 * | 2/2012 | Jones | ..... | 273/144 R |
| 8,221,214 | B2 * | 7/2012 | Nicely | ..... | 463/20 |

(Continued)

FOREIGN PATENT DOCUMENTS

| | | | |
|---|---|---|---|
| JP | 2000-334078 | A | 12/2000 |
| WO | 2004026418 | A1 | 4/2004 |

*Primary Examiner* — Melba Bumgarner
*Assistant Examiner* — Seng H Lim
(74) *Attorney, Agent, or Firm* — McDermott Will & Emery LLP

(57) ABSTRACT

A game system including a lottery apparatus which is coupled to a plurality of player terminal devices in a manner capable of information communication. The lottery apparatus includes the same number of rotation bodies as the number of rows M or columns N of a card. Each rotation body performs a lottery draw in association with the corresponding one of the rows or columns. The player terminal device includes an arrangement-determination section that sets an arrangement of symbols allocated in the cells included in each row or column of the card such that each of the allocated symbols is the same as any one of the symbols to be determined by a lottery draw in the corresponding rotation body to the each row or column.

5 Claims, 11 Drawing Sheets

(56) References Cited

U.S. PATENT DOCUMENTS

| | | | | |
|---|---|---|---|---|
| 8,308,547 | B2 * | 11/2012 | Walker et al. | 463/17 |
| 8,425,300 | B2 * | 4/2013 | Kane et al. | 463/19 |
| 2002/0169017 | A1 * | 11/2002 | Visoenik | 463/17 |
| 2004/0061285 | A1 * | 4/2004 | Hughes-Watts | 273/143 R |
| 2005/0159205 | A1 * | 7/2005 | Kukita | 463/17 |
| 2005/0250572 | A1 * | 11/2005 | Kane et al. | 463/17 |
| 2005/0253332 | A1 * | 11/2005 | Bonici | 273/138.1 |
| 2006/0163806 | A1 * | 7/2006 | Toyoda | 273/142 R |
| 2006/0170154 | A1 * | 8/2006 | Matsuno et al. | 273/142 R |
| 2008/0132316 | A1 * | 6/2008 | Fisher et al. | 463/17 |
| 2008/0139280 | A1 * | 6/2008 | Inamura | 463/17 |
| 2008/0207301 | A1 * | 8/2008 | Yokota et al. | 463/17 |
| 2008/0214270 | A1 * | 9/2008 | Kido | 463/17 |
| 2009/0061981 | A1 * | 3/2009 | Smith | 463/19 |
| 2009/0176548 | A1 * | 7/2009 | Nakamura et al. | 463/17 |
| 2009/0181748 | A1 * | 7/2009 | Nagano | 463/17 |
| 2009/0280904 | A1 * | 11/2009 | Nicely et al. | 463/40 |
| 2010/0102507 | A1 * | 4/2010 | Bontempo et al. | 273/142 R |
| 2010/0120487 | A1 * | 5/2010 | Walker et al. | 463/17 |
| 2012/0061912 | A1 * | 3/2012 | Sorge | 273/142 E |
| 2012/0112408 | A1 * | 5/2012 | Poon | 273/142 R |
| 2013/0059638 | A1 * | 3/2013 | Nicely | 463/17 |

* cited by examiner

| FIRST ROTATION BODY (IDENTIFICATION: RED) | |
|---|---|
| POCKET NUMBER (SENSOR NUMBER) | SYMBOL |
| N0.1 | 1 |
| N0.2 | 7 |
| N0.3 | 13 |
| ⋮ | |
| N0.15 | 85 |
| N0.16 | 4 |
| N0.17 | 10 |
| ⋮ | |
| N0.28 | 76 |
| N0.29 | 82 |
| N0.30 | 88 |

| SECOND ROTATION BODY (IDENTIFICATION: BLUE) | |
|---|---|
| POCKET NUMBER (SENSOR NUMBER) | SYMBOL |
| N0.31 | 2 |
| N0.32 | 8 |
| N0.33 | 14 |
| ⋮ | |
| N0.45 | 86 |
| N0.46 | 5 |
| N0.47 | 11 |
| ⋮ | |
| N0.58 | 77 |
| N0.59 | 83 |
| N0.60 | 89 |

| THIRD ROTATION BODY (IDENTIFICATION: GREEN) | |
|---|---|
| POCKET NUMBER (SENSOR NUMBER) | SYMBOL |
| N0.61 | 3 |
| N0.62 | 9 |
| N0.63 | 15 |
| ⋮ | |
| N0.75 | 87 |
| N0.76 | 6 |
| N0.77 | 12 |
| ⋮ | |
| N0.88 | 78 |
| N0.89 | 84 |
| N0.90 | 90 |

FIG. 4

| CELL NUMBER | ARRANGED SYMBOL |
|---|---|
| NO. 1 | 1 |
| NO. 2 | 7 |
| NO. 3 | 15 |
| NO. 4 | 27 |
| NO. 5 | 30 |
| NO. 6 | 35 |
| NO. 7 | 40 |
| NO. 8 | 48 |
| NO. 9 | 52 |
| NO.10 | 59 |
| NO.11 | 62 |
| NO.12 | 68 |
| NO.13 | 72 |
| NO.14 | 79 |
| NO.15 | 88 |

SECOND JACKPOT

| | | | | |
|---|---|---|---|---|
| 1 | 10 | 28 | 40 | 78 |
| 11 | 44 | 62 | 74 | 89 |
| 9 | 18 | 24 | 36 | 90 |

FIG. 8A

BINGO JACKPOT

| | | | | |
|---|---|---|---|---|
| 1 | 7 | 15 | 27 | 69 |
| 35 | 40 | 48 | 52 | 59 |
| 62 | 68 | 72 | 79 | 88 |

FIG. 8B

| CELL NUMBER | PAY LINE (PROGRESSIVE PAYOUT CONDITIONS) | |
|---|---|---|
| | SECOND JP | BINGO JP |
| NO. 1 | 1 | 1 |
| NO. 2 | 1 | 1 |
| NO. 3 | 1 | 1 |
| NO. 4 | 1 | 1 |
| NO. 5 | 1 | 1 |
| NO. 6 | 1 | 1 |
| NO. 7 | 1 | 1 |
| NO. 8 | 1 | 1 |
| NO. 9 | 1 | 1 |
| NO. 10 | 1 | 1 |
| NO. 11 | — | 1 |
| NO. 12 | — | 1 |
| NO. 13 | — | 1 |
| NO. 14 | — | 1 |
| NO. 15 | — | 1 |

FIG. 8C

LINE ×4

| | | | | |
|---|---|---|---|---|
| 1 | 16 | 28 | 40 | 73 |
| 11 | 44 | 62 | 74 | 89 |
| 9 | 18 | 24 | 36 | 90 |

FIG. 9A

BINGO ×1,000

| | | | | |
|---|---|---|---|---|
| 1 | 7 | 15 | 27 | 88 |
| 35 | 40 | 48 | 52 | 59 |
| 62 | 68 | 72 | 79 | 88 |

FIG. 9D

V ×2

| | | | | |
|---|---|---|---|---|
| 1 | 16 | 28 | 40 | 73 |
| 11 | 44 | 62 | 74 | 89 |
| 9 | 18 | 24 | 36 | 90 |

FIG. 9B

DOUBLELINE ×100

| | | | | |
|---|---|---|---|---|
| 1 | 16 | 28 | 40 | 73 |
| 11 | 44 | 62 | 74 | 89 |
| 9 | 18 | 24 | 36 | 90 |

FIG. 9E

T ×10

| | | | | |
|---|---|---|---|---|
| 1 | 16 | 28 | 40 | 73 |
| 11 | 44 | 62 | 74 | 89 |
| 9 | 18 | 24 | 36 | 90 |

FIG. 9C

LARGE SQUARE ×200

| | | | | |
|---|---|---|---|---|
| 1 | 16 | 28 | 40 | 73 |
| 11 | 44 | 62 | 74 | 89 |
| 9 | 18 | 24 | 36 | 90 |

FIG. 9F

| CELL NUMBER | PAY LINE (NORMAL LOTTERY PAYOUT CONDITIONS) | | | | | |
|---|---|---|---|---|---|---|
| | LINE (×4) | V (×2) | T (×10) | 2LINE (×100) | SQUARE (×200) | BINGO (×1000) |
| NO.1 | — | 1 | 1 | 1 | 1 | 1 |
| NO.2 | — | — | 1 | 1 | 1 | 1 |
| NO.3 | — | — | 1 | 1 | 1 | 1 |
| NO.4 | — | — | 1 | 1 | 1 | 1 |
| NO.5 | — | 1 | 1 | 1 | 1 | 1 |
| NO.6 | 1 | — | — | 1 | 1 | 1 |
| NO.7 | 1 | 1 | — | 1 | — | 1 |
| NO.8 | 1 | — | 1 | 1 | — | 1 |
| NO.9 | 1 | 1 | — | 1 | — | 1 |
| NO.10 | 1 | — | — | 1 | 1 | 1 |
| NO.11 | — | — | — | — | 1 | 1 |
| NO.12 | — | — | — | — | 1 | 1 |
| NO.13 | — | 1 | 1 | — | 1 | 1 |
| NO.14 | — | — | — | — | 1 | 1 |
| NO.15 | — | — | — | — | 1 | 1 |

FIG. 9G

ROULETTE GAME SYSTEMS AND ROULETTE GAME APPARATUS

CROSS REFERENCE TO PRIOR APPLICATIONS

This application is a U.S. National Phase Application under 35 U.S.C. §371 of International Application No. PCT/JP2010/066507, filed on Sep. 24, 2010 and claims benefit of priority to Japanese Patent Application No. 2009-223030, filed on Sep. 28, 2009. The International Application was published in Japanese on Mar. 31, 2011 as WO 2011/037165 A1 under PCT Article 21(2). All of these applications are incorporated herein by reference.

TECHNICAL FIELD

The present invention relates to a game system and a game apparatus to perform a bingo game or the like using a lottery function.

BACKGROUND ART

A lottery-type game apparatus such as a bingo game has been known as one kind of game apparatuses (see, for example, patent literature 1). Such a lottery-type game apparatus performs a lottery draw using a single roulette.

CITATION LIST

Patent Literature

[PTL 1] U.S. Pat. No. 5,639,089, Description

SUMMARY OF INVENTION

Technical Problem

However, a conventional game apparatus has a problem that a player feels a sense of monotony because the lottery by a single roulette fails to entertain, and thus the game lacks excitement.

Therefore, an object of the present invention is to provide a game system and a game apparatus, which can make a player feel more fun than ever before and sufficiently enhance excitement of a game.

Solution to Problem

To achieve the above-described object, a major object of the present invention is to provide A game system including: a plurality of player terminal devices; and a lottery apparatus coupled to the plurality of player terminal devices in a manner capable of information communication, wherein the lottery apparatus includes a plurality of rotatable rotation bodies having a plurality of pockets, a supply section that supplies the rotation body with a lottery body, a detection section that detects entering of the lottery body into a pocket, the lottery body being supplied to the rotation body, a storage section storing a program of a lottery game that is performed by causing the lottery body to enter the pocket, and a control section that controls a progress of the lottery game based on the program, the player terminal device includes a display section that displays a game image including a bet target formed of a combination of a plurality of symbols, an acceptance section that accepts an input of a game value, and a betting operation section through which a player bets the game value on the bet target, the bet target is set as a card in which a symbol is allocated to each of a plurality of cells arranged in a matrix form consisting of M rows and N columns (M, N are integers equal, to or larger than 2), the same number of the rotation bodies are provided as the number of either one of the rows M and the columns N of the card, and correspond to the either one of the rows and the columns, the symbols are allocated in a manner that symbols respectively corresponding to the plurality of pockets provided in one of the plurality of rotation bodies do not overlap symbols respectively corresponding to the plurality of pockets provided in any other rotation body, the control section controls supply of the lottery body to each rotation body by the supply section, and performs a lottery draw by determining a corresponding symbol to the pocket, based on a detection signal transmitted from the detection section, every when each lottery body of each rotation body enters any of the pockets, and the player terminal device further comprises an arrangement-determination section that sets an arrangement of the symbols allocated in the cells included in each row or column of the card such that each of the allocated symbols is the same as any of the symbols to be determined by the lottery draw in the corresponding rotation body to the each row or column.

Other characteristics of the present invention will be apparent by the description and the accompanied drawings.

BRIEF DESCRIPTION OF DRAWINGS

FIG. 4 is a table illustrating a correspondence relationship between pockets (sensors) and symbols.

FIGS. 8A to 8C are tables illustrating payout conditions in a progressive lottery.

FIGS. 9A to 9G are tables illustrating payout conditions in a normal lottery.

MODE FOR CARRYING OUT THE INVENTION

Outline of the Disclosure

Figure 1:
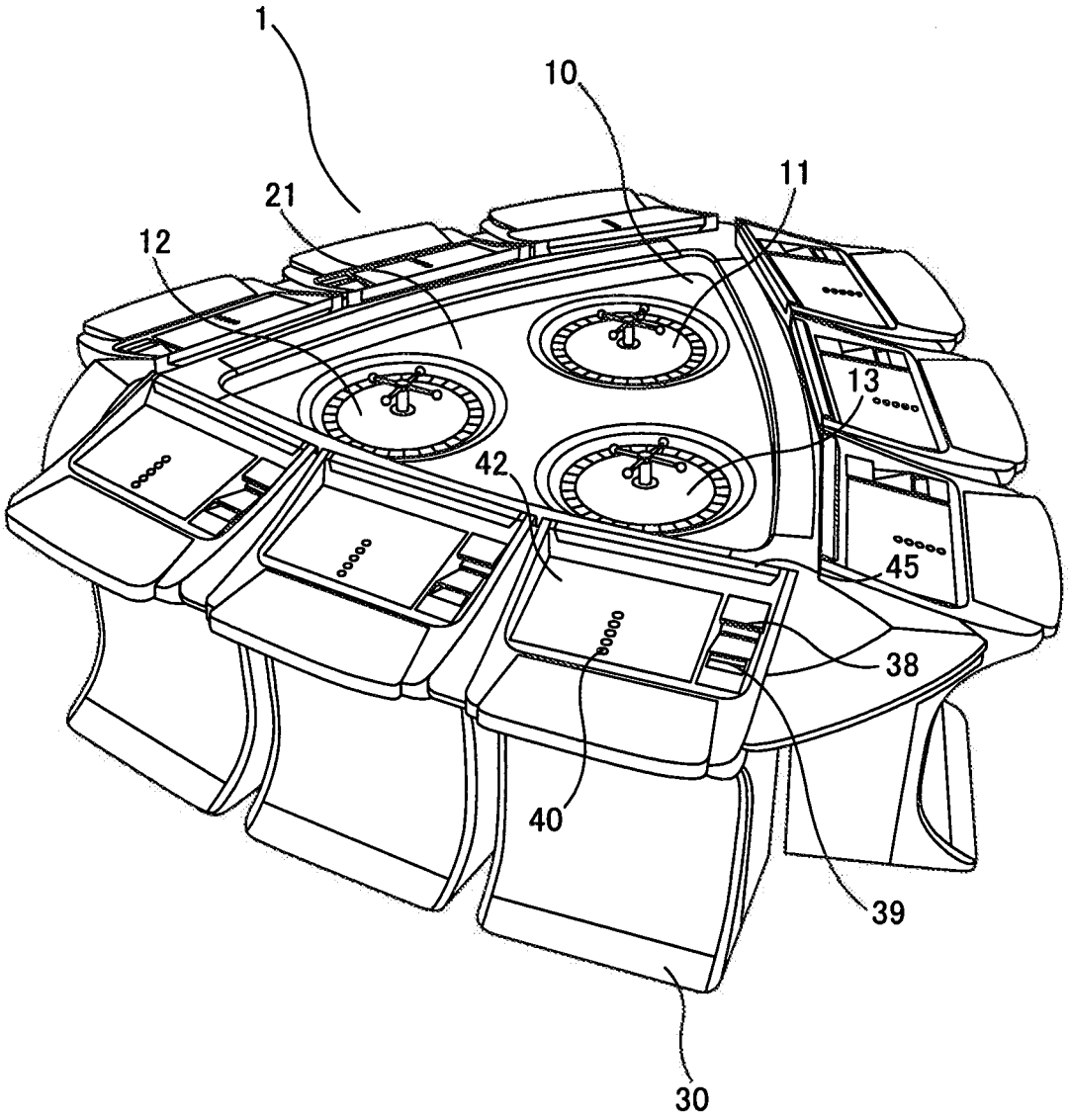
FIG. 1 is a perspective view showing an example of an appearance of a game system according to the invention.

With the description and the accompanied drawings, at least the following matters will be apparent.

A game system including: a plurality of player terminal devices; and a lottery apparatus coupled to the plurality of player terminal devices in a manner capable of information communication, wherein the lottery apparatus includes a plurality of rotatable rotation bodies having a plurality of pockets, a supply section that supplies the rotation body with a lottery body, a detection section that detects entering of the lottery body into a pocket, the lottery body being supplied to the rotation body, a storage section storing a program of a lottery game that is performed by causing the lottery body to enter the pocket, and a control section that controls a progress of the lottery game based on the program, the player terminal device includes a display section that displays a game image including a bet target formed of a combination of a plurality of symbols, an acceptance section that accepts an input of a game value, and a betting operation section through which a player bets the game value on the bet target, the bet target is set as a card in which a symbol is allocated to each of a plurality of cells arranged in a matrix form consisting of M rows and N columns (M, N are integers equal to or larger than 2), the same number of the rotation bodies are provided as the number of either one of the rows M and the columns N of the card, and correspond to the either one of the rows and the columns, the symbols are allocated in a manner that symbols respectively corresponding to the plurality of pockets provided in one of the plurality of rotation bodies do not overlap symbols respectively corresponding to the plurality of pockets provided in any other rotation body, the control section controls supply of the lottery body to each rotation body by the supply section, and performs a lottery draw by determining a corresponding symbol to the pocket, based on a detection signal transmitted from the detection section, every when each lottery body of each rotation body enters any of the pockets, and the player terminal device further comprises an arrangement-determination section that sets an arrangement of the symbols allocated in the cells included in each row or column of the card such that each of the allocated symbols is the same as any of the symbols to be determined by the lottery draw in the corresponding rotation body to the each row or column.

Such game system can make a player feel more fun than ever before.

Also, in such game system, it is possible that the player terminal device further includes a payout section that pays a prize game value and a determination section that determines based on a result of the lottery game whether a player obtains a prize game value, the program of the lottery game includes a bet mode, a lottery mode, and a payout mode, in the bet mode, the control section accumulates a part of a total amount of the game value as an amount of resource to pay out in the payout mode, the game value being bet by a player who operates the player terminal device, and the control section stores the accumulated value as resource data in the storage section, the lottery mode is preset so that a lottery result is determined by performing the lottery draw in a plurality of stages, in a first stage in which a first lottery draw is performed, the control section controls supply of a plurality of the lottery bodies to each rotation body by the supply section, and the control section determines a corresponding symbol to the pocket based on a detection signal transmitted from the detection section, every when each lottery body of each rotation body enters any of the pockets, the determination section determines whether a predetermined payout condition is fulfilled by comparing the determined symbol with the symbols arranged in the card, and in the payout mode, when the payout condition is fulfilled, the payout section controls paying of an amount of the game value which is subtracted from the resource value corresponding to the resource data.

Such game system can maintain a sense of excitement and anticipation of the game.

Also, in such game system, it is possible that the plurality of stages includes a second stage and a third stage in each of which the lottery draw is performed after the first stage, before the lottery draw of the first stage, the control section determines whether the lottery draw is performed in the third stage, in the second stage which takes place after the lottery draw of the first stage is finished, the control section controls supply of a smaller number of the lottery bodies to each rotation body by the supply section than the number of the lottery bodies supplied in the first stage, and the control section determines a corresponding symbol to the pocket based on a detection signal transmitted from the detection section, every when each lottery body in each rotation body enters any of the pockets, and when it is determined that the lottery draw is performed in the third stage after the lottery draw of the second stage is finished, the control section controls supply of a single lottery body to each rotation body by the supply section, and the control section controls determining a corresponding symbol to the pocket based on a detection signal transmitted from the detection section, when the lottery body in each rotation body enters any of the pockets.

Such, game system can make variations in the speed of the progress of the game in a way that lottery results in the first stage and the second stage are determined quickly and a lottery result in the third stage is determined slowly. Thus, a player can feel more fun than ever before, and the excitement and anticipation of the game can be maintained.

Also, in such game system, it is possible that identification information is set for each of the rotation bodies, and the game system further comprises an image creation section that creates a game image when the symbol is determined by the lottery draw in one of the plurality of rotation bodies, the game image including a card in which a label corresponding to the identification information of the one rotation body is added to a cell to which the determined symbol is allocated.

According to such game system, a player can visually recognize which one of the rotation bodies performs the lottery draw which determines the symbol of the card of the player.

Moreover, a game apparatus including: a plurality of rotatable rotation bodies having a plurality of pockets; a supply section that supplies the rotation body with a lottery body; a detection section that detects entering of the lottery body into a pocket, the lottery body being supplied to the rotation body; a storage section storing a program of a lottery game that is performed by causing the lottery body to enter the pocket; a control section that controls a progress of the lottery game based on the program; a display section that displays a game image including a bet target formed of a combination of a plurality of symbols; an acceptance section that accepts an input of a game value; and a betting operation section through which a player bets the game value on the bet target, wherein the bet target is set as a card in which a symbol is allocated to each of a plurality of cells arranged in a matrix form consisting of M rows and N columns (M, N are integers equal to or larger than 2), the same number of the rotation bodies are provided as the number of either one of the rows M and the columns N of the card, and correspond to the either one of the rows and the columns, the symbols are allocated in a manner that symbols respectively corresponding to the plurality of pockets provided in one of the plurality of rotation bodies do not overlap symbols respectively corresponding to the plurality of pockets provided in any other rotation body, the control section controls supply of the lottery body to each rotation body by the supply section, and performs a lottery draw by determining a corresponding symbol to the pocket based on a detection signal transmitted from the detection section, every when each lottery body of each rotation body enters any of the pockets, and the game apparatus further comprises an arrangement-determination section that sets an arrangement of the symbols allocated in the cells included in each row or column of the card such that each of the allocated symbols is the same as any of the symbols to be determined by the lottery draw in the corresponding rotation body to the each row or column.

The game apparatus achieved as described above can make a player feel more fun than ever before and can maintain the excitement and anticipation of the game.

Note that the above-described control section to control the game may be included in a lottery apparatus as a single unit as shown in the following embodiment. However, a separate-type lottery apparatus may be employed in which a control section of the lottery apparatus is disposed in a different position from a roulette wheel. The present invention is not intended to exclude an advanced-type of such separate type in which a control section itself to control a game is installed outside of a game center and controls the game remotely. Also, it is possible to set one player terminal device as a host computer and to cause the host computer to play a role of a control section. However, when considering an increase or a decrease in the number of betting inputs in a plurality of player terminal devices, it is preferable that a lottery apparatus play a role as a control section, as will be shown in the embodiment to be described later.

In order to make this clearer, the following lottery apparatuses are described without use of expression to limit subordination between the lottery apparatus and the control section, thereby making it clearer that there are both configurations: one in which a lottery apparatus and a control section are formed in a single body and the other in which they are separately formed.

Specifically, a game system including a lottery apparatus including a roulette wheel; a plurality of player terminal devices; and a control section that receives bet information from the plurality of player terminal devices and that performs according to a game program a game in which a result of the game for each player terminal device is determined based on a relationship between a lottery result obtained by the lottery apparatus and the bet information, wherein the lottery apparatus includes a plurality of the roulette wheels, a supply section including a shoot port to throw a ball along an outer circumference of each of the plurality of roulette wheels, a movement prevention wall to prevent the ball supplied from the supply section to one roulette wheel from moving to another roulette wheel, and a pocket that accommodates a ball and is provided between the outer circumference of the roulette wheel and the movement prevention wall, identification information that is displayed on the pocket in a visible manner from an outside and is allocated so that identification information corresponding to the pocket of one roulette wheel does not overlap that corresponding to the pocket of any other roulette wheel, and a sensor that determines whether the ball is accommodated in each pocket, and the control section performs (a) processing of accepting bet information from the plurality of player terminal devices, (b) after the processing (a), processing of controlling the supply section so that a plurality of balls are thrown into each of the roulette wheels, and (c) processing of detecting by the sensor the pocket in which the ball are accommodated in each roulette wheel, and processing of determining a game result for each player terminal device based on the bet information and a plurality of pieces of the identification information corresponding to the pockets in which the balls are accommodated.

According to the present invention, compared with a case of using one roulette wheel, various technical effects as shown below can be expected when using a combination of the identification information or a combination with a bingo card like a bingo game to be described later, the combination being realized by roulette wheels with a group of one in which a ball is accommodated.

A. Like a bingo game, when there is a need to get a larger number of kinds of identification information to be obtained by a lottery apparatus than a roulette game, it is necessary to increase the number of pockets formed in the outer circumference of one roulette wheel. However, when the number of pockets increased, a diameter has to be also increased, which results in causing a problem that a lottery apparatus becomes larger. However, according to the present invention, a plurality of roulette wheels are employed and identification information corresponding to the pockets formed in one roulette wheel is set without duplicates of identification information of the pockets in other roulette wheels, so that the above-described problem can be solved.

B. In addition, as compared with a case where a roulette wheel is made larger and multiple balls are thrown at one time to perform a lottery draw, there is a possibility to facilitate designing because it does not need a difficult control to solve various problems as follows: balls gather together in a certain position so that the movement of the balls becomes less powerful; or the like.

C. From a plurality of kinds of identification information, the same number of kinds of identification information as the number of balls can be obtained by throwing the same number of balls as certain balls at one time in a plurality of roulette wheels. Furthermore, the lottery draw is performed by the roulette wheel, which means that the lottery process can be visually recognized by a player visually following the ball on the roulette wheel. Thus, it is also preferable in terms of appealing that the lottery does not include any cheating.

D. Furthermore, when the number of kinds of identification information to be obtained by the lottery draw is increased, the number of roulette wheels can be further increased according to the increase. In this manner, there is a possibility of enhancing freedom of designing.

E. Also, when roulette wheels are associated with, different colors as described in an embodiment to be described later, there is an advantage that a player can easily recognize one roulette wheel to be focused to follow the lottery process of identification information relating to the player.

In the description of the following embodiment, a bingo game system is provided as an example of a game system or a game apparatus.

First Embodiment

As for Configuration of Game System

FIG. 1 is an outer perspective view of a bingo game system 1 to which a game system according to the present invention is applied.

The bingo game system 1 includes a lottery apparatus 10 formed in a substantial triangular prism shape and a plurality of player terminal devices 30*a* to 30*j*.

The lottery apparatus 10 includes a substantially triangular field 21 on the upper portion of a main body, and the field 21 includes a first rotation body 11 (a first roulette wheel 11), a second rotation body 12 (a second roulette wheel 12), and a third rotation body (a third roulette wheel 13).

The player terminal devices 30*a* to 30*j* are devices for a plurality of players to perform a game operation, and there are provided on the upper portion of the main body thereof a display section 42 to display a game image, a betting operation section 40 through which a player makes an input relating to a betting operation (a gambling operation), a value input section 38 through which a player inserts or inputs a game value for betting on a bingo card which is a bet target, and a value payout section 39 to pay or output the game value to the player. Furthermore, a light-emitting section 45 which includes a light-emitting diode and the like is provided above the display section 42.

Here, in the present embodiment, objects that players use for playing, such as medals and tokens for playing, cash, electronic money such as a credit card and debit card, or electronic points, are collectively referred to as "game values".

Figure 2:
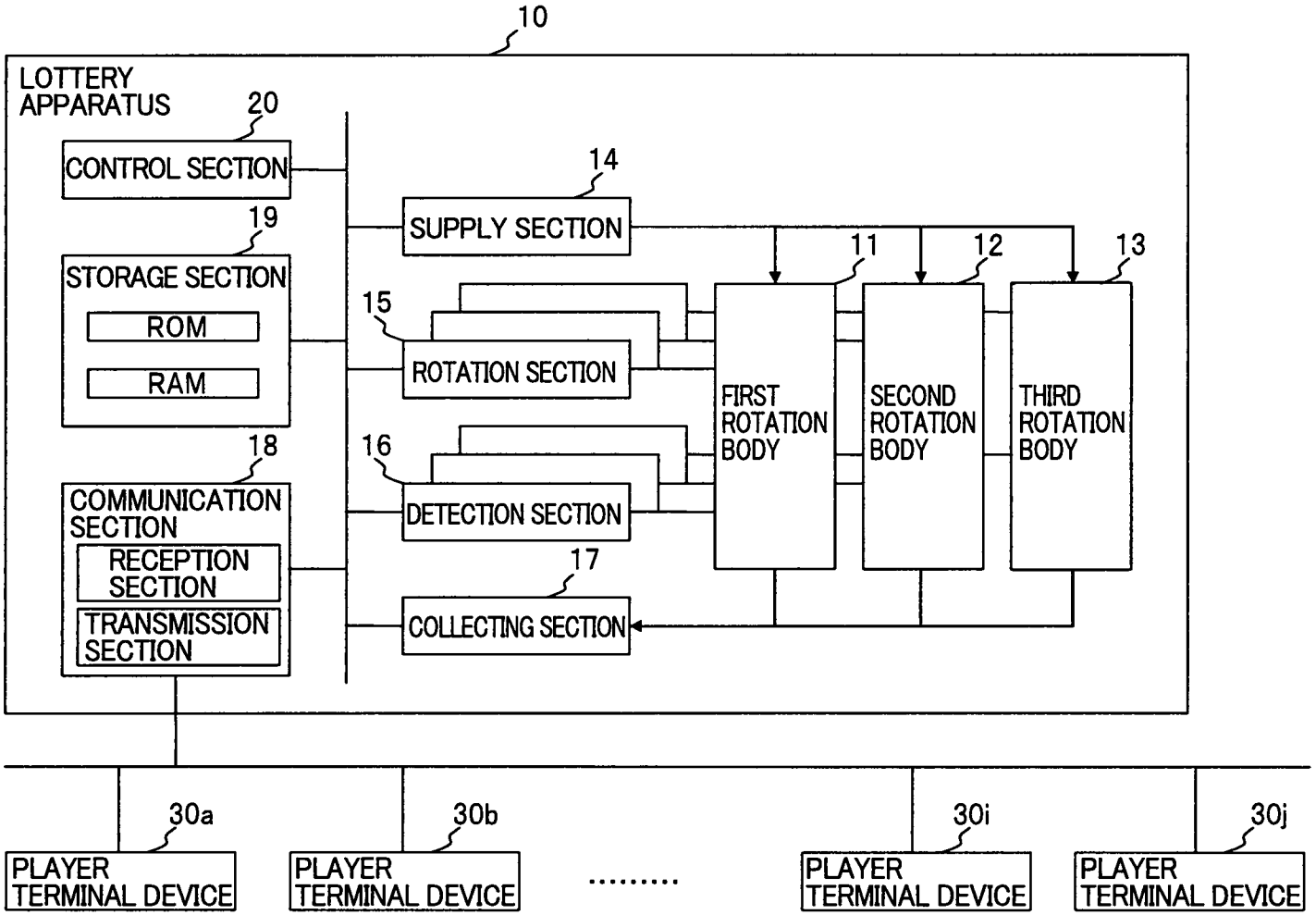
FIG. 2 is a schematic block diagram showing a functional configuration of the game system.

FIG. 2 shows the schematic block diagram showing the configuration of the bingo game system 1 to which the present invention is applied. The bingo game system 1 is coupled to the lottery apparatus 10 and the player terminal devices 30*a* to 30*j* in a manner capable of information communication and can transmit/receive various pieces of data and signals.

<As for Configuration of Lottery Apparatus>

Furthermore, FIG. 2 shows a block diagram showing the functional configuration of the lottery apparatus 10. The lottery apparatus 10 has a control section 20 such as a CPU (Central Processing Unit), a storage section 19 such as a RAM (Random Access Memory) or a ROM (Read Only Memory), a communication section 18 to be coupled to the player terminal devices 30*a* to 30*j* in a manner capable of information communication, roulette wheels 11, 12, and 13 as rotation bodies, a supply section 14 to supply the roulette wheels with a lottery body such as a ball, a rotation section 15 to rotate the roulette wheels, a detection section 16 such as an optical sensor, and a collecting section 17 to collect the supplied lottery body.

The control section 20 has functions to perform various controls and information processing with regard to the progress of a bingo game.

The storage section 19 includes: a ROM which is a read-only memory region in which a system program including a game program of the bingo game system in the embodiment is stored; and a rewritable RAM in which data created in the control section 20 (flag or operated value to be used in a lottery game program) is stored and which is used as a work area of the operation processing in the control section 20.

The storage 19 is coupled to the control section 20 via a bus and performs processing of look-up, read and rewrite of the stored data according to the processing of the control section 20.

As will be described later, at least a bet mode, a lottery mode, and a payout mode are switched to execute various processing in the program of the bingo game system.

The communication section 18 has a function to couple the lottery apparatus 10 with the player terminal devices 30*a* to 30*j* in a manner capable of information communication and includes a reception section and a transmission section. The reception section has a function to receive various kinds of data and signals which are transmitted from the player terminal devices 30*a* to 30*j*. The transmission section has a function to transmit various kinds of data and signals according to the processing of the control section 20.

The supply section 14 includes a ball supplying mechanism (not shown) to supply each roulette wheel with a ball as a lottery body, and has a function to supply the roulette wheel with the ball by driving a supply driving section, such as a motor, based on a control signal from the control section 20.

Note that the supply section 14 may be provided in plurality corresponding to the roulette wheels or may be commonly used.

A ball supplying port (a ball shoot port) is provided corresponding to each roulette wheel, and the ball discharged from each ball supplying port reaches the corresponding roulette wheel.

The roulette wheels as rotation bodies include three of the first roulette wheel 11 (the first rotation body 11), the second roulette wheel 12 (the second rotation body 12), and the third roulette wheel 13 (the third, rotation body 13), each being configured rotatable about a rotation axis.

Since each roulette wheel is independently configured, a ball does not go back and forth between the roulette wheels during the rotation once the ball is supplied from the supply section 14. In each of the three roulette wheels of the first roulette wheel 11 (the first rotation body 11), the second roulette wheel 12 (the second rotation body 12), and the third roulette wheel 13 (the third rotation body 13), an unillustrated wall to prevent the thrown ball from traveling to another wheel is provided.

With such configuration, a plurality of balls thrown onto the roulette wheels are not gathered in any one of the roulette wheels. If gathered, the configuration becomes like one that plural balls are all together supplied to one roulette wheel. This causes the following problems: that collisions are often caused between the balls to cause control of the rotation speed of the roulette wheels or control of the speed of throwing the balls to be difficult; that the balls gather in a specific portion on the roulette wheel and become unmovable to cause a biased lottery result; that a correspondence relationship with a bingo card becomes difficult to be visually recognized, or the like. Accordingly, to solve these problems, it is useful to have the configuration in which each roulette wheel is provided independently.

Also, each roulette wheel has a plurality of pockets, each being capable of accommodating a ball as a lottery body.

The rotation section 15 is configured including a rotation mechanism (not shown) to rotate a roulette wheel with the lottery body being mounted, on the upper surface thereof, and has a function to rotate the roulette wheel by driving the rotation driving section, such as a motor, based on the control signal from the control section 20.

The detection section 16 is coupled to the control section 20 via a bus and is provided corresponding to each pocket of the roulette wheel. When each of the balls supplied to the respective roulettes enters any of the pockets, the detection section 16 provided corresponding to the pocket transmits a detection signal, the signal showing that the ball is detected to the control section 20.

The collecting section 17 includes a ball collecting mechanism (not shown) to collect the ball accommodated in the pocket of the roulette wheel, and has a function to collect the ball accommodated in the pocket by driving the driving section, such as a motor, based on the control signal from the control section 20.

Note that, the ball collected by the collecting section 17 is gathered once in a ball accommodation section (not shown). Then, the ball in the ball accommodation section is guided by a ball guide and reaches the supply section 14, and then is supplied to the roulette wheel again by the supply section 14.

<As for Field>

Figure 3:
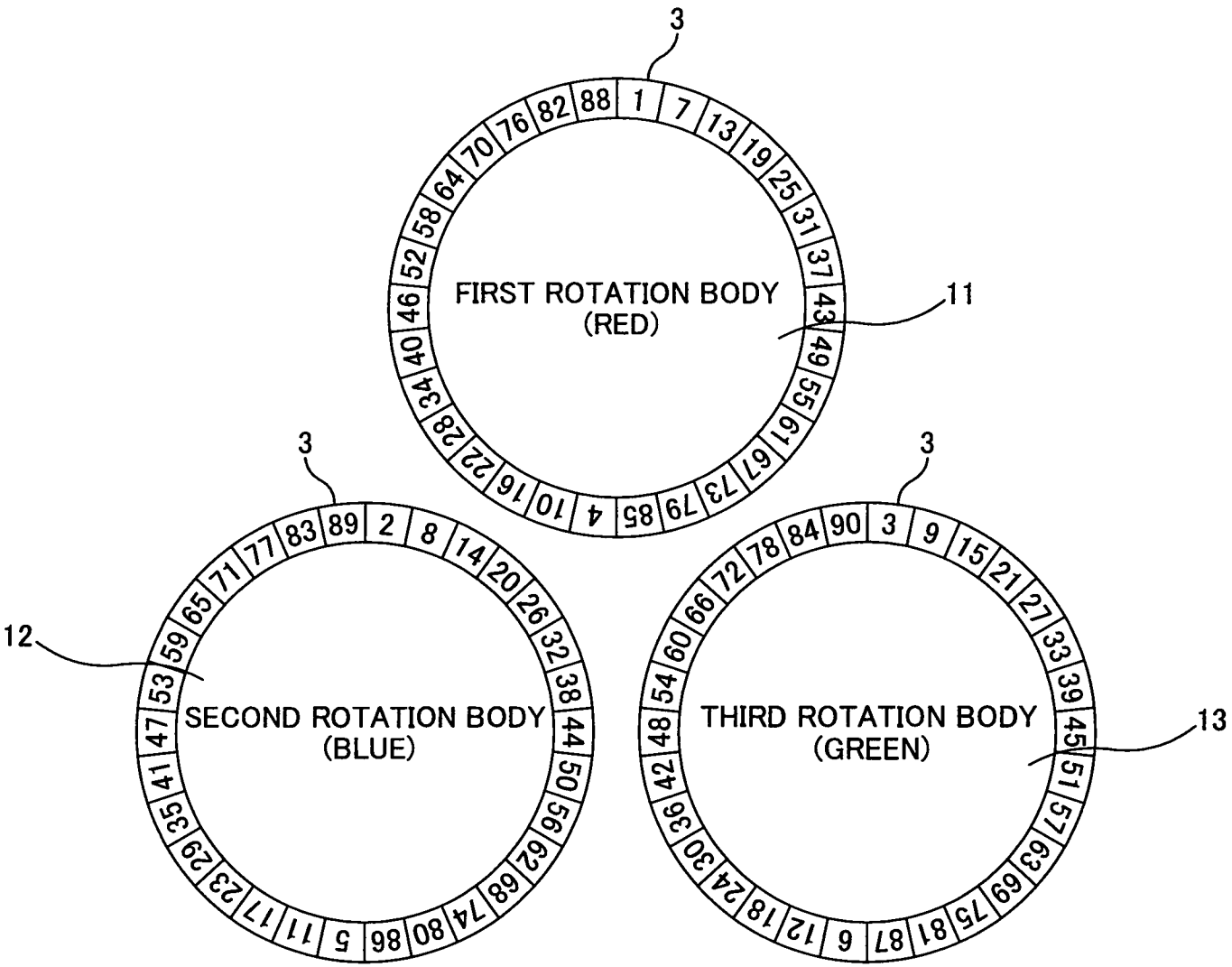
FIG. 3 is an explanatory diagram of a field of a lottery apparatus.

FIG. 3 is an illustration of the filed 21 provided on the upper portion of the lottery apparatus 10.

The field 21 includes the first roulette wheel 11, the second roulette wheel 12, and the third roulette wheel 13 which are provided to form a triangular shape when centers of the roulette wheels are coupled to one another.

As described above, since there are three roulette wheels, a lottery time can be shortened, and thus a waiting time of a player can be shortened.

In addition, the design is made such that the first roulette wheel 11 is colored in red, the second roulette wheel 12 is colored in blue, and the third roulette wheel 13 is colored in green, so that a player can easily visually recognize these roulette wheels.

Each roulette wheel has a disk-like shape and has an inclined portion gently inclined outwardly from the center portion in a radius direction. A plurality of pockets 3 are provided in the outer periphery and are disposed next to each, other along a circumferential direction.

Then, a symbol is affixed to each pocket. For example, symbols like "1", "7", "13", . . . are clockwisely provided in the pockets of the first roulette wheel 11, symbols like "2", "8", "14", . . . are clockwisely provided in the pockets of the second roulette wheel 12, and symbols like "3", "9", "15", . . . are clockwisely provided in the pockets of the third roulette wheel 13, so that a player can visually recognize the symbols.

Note that the symbols are not limited to numbers, but may be any of letters, signs, motives, figures, and the like as long as there are a plurality of kinds to be capable of identifying itself from others.

Each pocket is formed to be sunken and includes a partition plate to separate between the adjacently-provided pockets. With this configuration, the ball which is supplied by the supply section 14 and rolls on the roulette wheel gradually slows down its speed, loses intensity of the movement, and then falls into the pocket, so that the ball is accommodated and held in the pocket.

Since the detection section 16 to detect the ball is provided corresponding to each pocket, once the ball is accommodated in the pocket, the control section 20 can determines the pocket which the ball entered by receiving a detection signal which is transmitted from the detection section 16.

FIG. 4 is a table illustrating a correspondence relationship between pockets (or sensors) and symbols.

A corresponding packet number is set for each pocket in advance. The pockets provided in the first roulette wheel 11 are respectively corresponding to No. 1 to No. 30, and the pockets provided in the second roulette wheel 12 are respectively corresponding to No. 31 to No. 60, and the pockets provided in the third roulette wheel 13 are respectively corresponding to No. 61 to No. 90.

Note that, since a sensor is provided corresponding to each pocket, a corresponding sensor number may be set in advance in place of the pocket number.

Accordingly, this means that 30 pockets are provided in each roulette wheel and also means that 30 sensors are provided in each roulette wheel.

Specifically, for example, as for the first roulette wheel 11, a symbol "1" corresponds to the pocket number (or the sensor number) No. 1, a symbol "7" corresponds to the pocket number No. 2, and a symbol "13" corresponds to the pocket number No. 3. In this manner, the symbols "1", "7", and "13" are determined only by the lottery draw of the first roulette wheel 11, and are not determined by the lottery draw of the second roulette wheel 12 or the third roulette wheel 13. This reduces a burden of monitoring by a player waiting for the symbol "1" to win when the player is one step away from winning the game, because the player only needs to pay attention to the first roulette wheel 11 even when there are a plurality of roulette wheels.

Also, for example, as for the second roulette wheel 12, a symbol "2" corresponds to the pocket number (or the sensor number) No. 31, a symbol "8" corresponds to the pocket number No. 32, and a symbol "14" corresponds to the pocket number No. 33. In this manner, the symbols "2", "8", and "14" are determined only by the lottery draw of the second roulette wheel 12.

Furthermore, for example, as for the third roulette wheel 13, a symbol "3" corresponds to the pocket number (or the sensor number) No. 61, a symbol "9" corresponds to the pocket number No. 62, and a symbol "15" corresponds to the pocket number No. 63. In this manner, the symbols "3", "8", and "14" are determined only by the lottery draw of the third roulette wheel 13.

In other words, the symbols are allocated in a manner that symbols respectively corresponding to the pockets provided in one certain roulette wheel do not overlap the symbols respectively corresponding to the pockets in the two other roulette wheels. Thus, a lottery result is determined quickly without duplication, so that a player can feel more fun than ever before.

The storage section 19 stores in advance the table data showing the correspondence relationship between the pocket numbers or the sensor numbers and the symbols. Then, every when the control section 20 receives via a bus line a detection signal which is transmitted from the sensor provided corresponding to the pocket that the ball enters, the control section 20 can identify a sensor number of the sensor and can identify the symbol corresponding to the sensor number by referring to the data table in the storage section 19. Accordingly, the symbol to be a lottery result is determined in the lottery apparatus.

<As for Configuration of Player Terminal Device>

Figure 5:
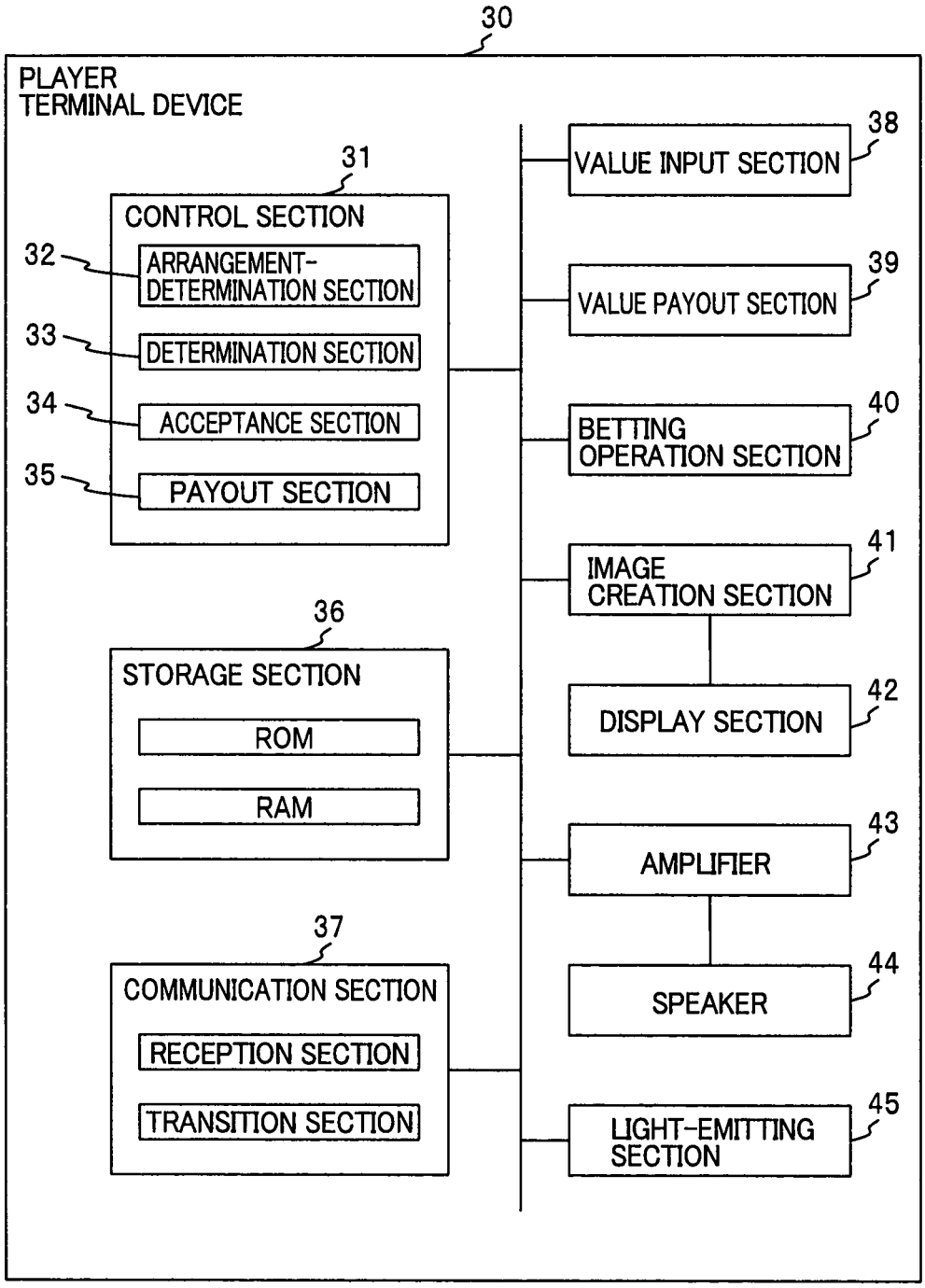
FIG. 5 is a schematic block diagram showing a functional configuration of a player terminal device.

FIG. 5 shows a block diagram showing the functional configuration of the player terminal device 30. The player terminal device 30 is a device in which each player performs a game operation, and includes: a control section 31 such as a CPU (Central Processing Unit); a storage section 36 such as a ROM (Read Only Memory) or RAM (Random Access Memory); a communication section 37 to couple in a manner capable of information communication with the lottery apparatus 10; a value input section 38 to insert or input a game value (such as cash, medals or tokens for play, or points) for a player to bet on a bingo card being a bet target; a value payout section 39 to pay or output a game value for the player; a betting operation section 40 through which the player inputs the betting operation; an image creation section 41 to create a game image; a display section to display the game image; a speaker to output a sound relating to the game via an amplifier 43; and a light-emitting section 45 including an LED and the like.

The control section 31 performs various kinds of control and information processing relating to the progress of the bingo game in the player terminal device 30, and is configured to function as an arrangement-determination section 32, a determination section 33, an acceptance section 34, and a payout section 35.

The arrangement-determination section 32 performs processing of selecting any of the symbols "1" to "90" at an initial setting time which is a previous stage of a bet mode to be described later and determining an arrangement by allocating the selected symbol in each cell in the bingo card.

Figure 6:
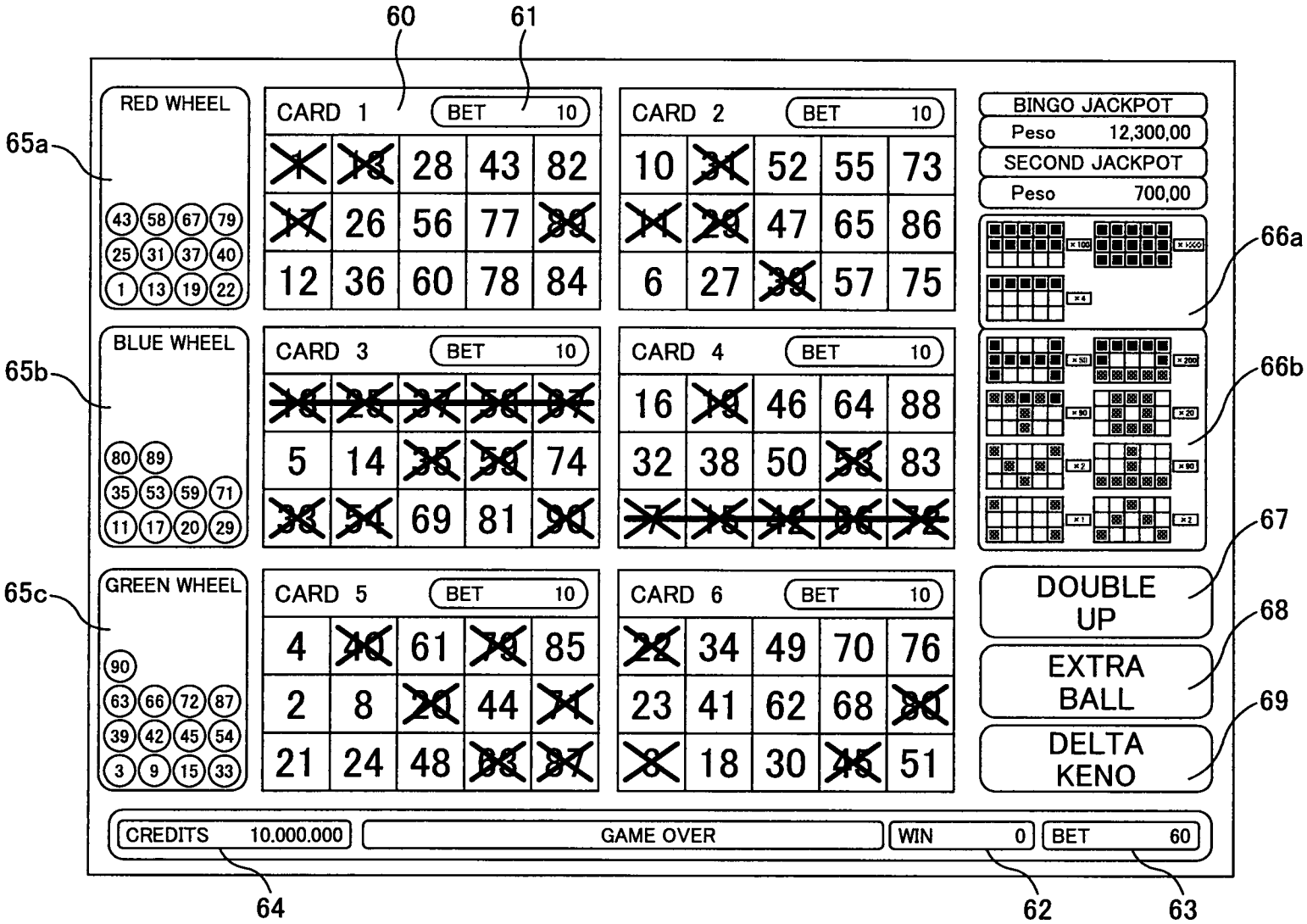
FIG. 6 is an explanatory diagram of a game screen of the player terminal device.

As shown in the game screen of the player terminal device 30 in FIG. 6, in the present embodiment, the display section 42 displays a game image in which 6 kinds of bingo cards, each having cells arranged in a matrix of 3 rows and 5 columns, are divided into each region. Also, the bingo card according to the embodiment is set so that the number of rows (three) becomes the same with the number of the roulette wheels (three). Note that, roulette wheels (five) may be provided to have the number same as not only the rows but also the columns (for example, five).

Accordingly, the arrangement-determination section 32 determines a symbol to be allocated to each of 15 cells with respect to each of the 6 bingo cards.

Figures 7A, 7B:
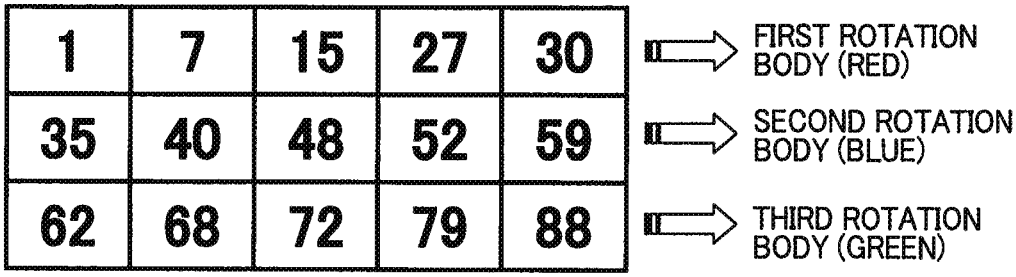
FIGS. 7A and 7B are explanatory diagrams of a bingo card.

At this time, like the bingo card shown in FIG. 7A, the number of the rows (three) of the bingo card is the same as the number of the roulette wheels (three). Thus, the arrangement-determination section 32 selects the symbol to be allocated in each cell on the first row out of the symbols to be determined by the lottery draw in the first roulette wheel 11. Also, the symbol to be allocated in each cell on the second row is arranged so that the symbol is the same as the symbol to be determined by the lottery draw in the second roulette wheel 12, and the symbol to be allocated in each cell on the third row is arranged so that the symbol is the same as the symbol to be determined by the lottery draw in the third roulette wheel 13.

Since each row of the bingo card corresponds to each roulette wheel in the above manner, a player who is one step away from winning the game needs to identify only the row including the symbol to be focused and pay attention only to the roulette wheel corresponding to the row. For this reason, even though there are a large number of roulette wheels, a symbol which is likely to win can be easily visually checked.

Like the bingo card shown in FIG. 7A, since the cell number is assigned for each cell in advance, when the symbol arranged for each cell is determined by the arrangement-determination section 32, the control section stores information relating to the determined symbol into an address on the memory (RAM), the address corresponding to the cell number.

That is, as shown in FIG. 7B, to the cell number No. 1 the symbol "1" is allocated, to the cell number No. 2 the symbol "7" is allocated, and to the cell number No. 3 the symbol "15" is allocated. Similarly, to the cell number No. 13 the symbol "72" is allocated, to the cell number No. 14 the symbol "79" is allocated, and to the cell number No. 15 the symbol "88" is allocated. Thus, the arrangement information of the bingo card is created by the arrangement-determination section 32. In other words, the arrangement information in which total 15 symbols are respectively associated with the cell numbers for one bingo card is created and stored in a predetermined memory region in the storage section 36.

In a lottery mode to be described later, the determination section 33 compares the symbol which is a lottery result determined by the lottery draw of the lottery apparatus 10 with the symbol which is included in the arrangement information of the bingo card stored in the storage section 36, and determines whether or not a payout condition in which a game value is paid as a prize is fulfilled. In other words, based on the arrangement of the symbols included in the bingo card, it is determined whether the bingo is completed or a preset pay line (see, FIGS. 8, 9) is completed. It is also determined whether a situation of being one step away from winning the game is established.

The value input section 38 includes: an insertion port to insert a bill or a slot to insert a coin; and a detection sensor to detect the inserted bill or coin. Note that, if the game value is electronic data or electronic money such as points not a bill, token, or medal, the value input section 38 may also include an interface to read data stored in an IC card or magnetic card.

A function of the acceptance section 34 is to receive an input signal and information when the game value is input to the value input section 38 and to store an amount of the input game value as credit data in the storage section 36. Also, when a player performs a betting operation, the acceptance section receives the input signal and information and subtracts the amount of the bet game value from the credit data.

A function of the payout section 35 is to perform processing of determining an amount of game values that the player will obtain as the prize as a result of the bingo game. Specifically, an amount of the prize game values is operated based on the amount of the bet game value, the established state of the payout conditions (such as the number of completed bingo lines) or the like. Then, the amount of the prize game values is added to the credit data which has already stored in the storage section 36. Note that the prize game values may be added to the credit in response to the paying operation made by the player or may be automatically paid with a predetermined timing.

The value payout section 39 include: a payout port to pay the game value converted from the credit data; and the detection sensor to detect that the game value is paid. Note that, if the game value is electronic data or electronic money such as points not a bill, token, or medal, the value payout section 39 may include an interface to write data in an IC card or magnetic card.

The storage section 36 includes: a ROM which is a read-only memory area in which a program of a bingo game in the player terminal device 30 is stored; and a RAM in which data created in the control section 31 (such as a flag or operated value to be used in the program of the bingo game, or arrangement information of the bingo card) is stored and which is a rewritable storage region used as a work area of an operation processing in the control section 31. The storage section 19 is coupled to the control section 31 via a bus and performs processing of look-up, read and rewrite of the stored data according to the processing of the control section 31.

The communication section 37 has a function to couple the lottery apparatus 10 with the player terminal devices 30*a* to 30*j* in a manner capable of information communication and includes a reception section and a transmission section. The reception section has a function to receive various kinds of data and signals which are transmitted from the lottery apparatus 10. The transmission section has a function to transmit various kinds of data and signals according to the processing of the control section 31.

The image creation section 41 creates a game image including the bingo card under the control of the control section 31, and the created game image is displayed on the display section 42.

The betting operation section 40 is configured including a touch panel. The player touches the bingo card displayed on the display section 42 to select a bet target, or touches the betting button displayed on the display section 42; thereby performing an operation to input a desired betting amount (an amount of betting game values).

The light-emitting section 45 is configured including an element in which a plurality of light-emitting diodes of red, green, and blue are mounted to be capable of emitting full-colored light, and emits color light according to the game state under the control of the control section 31. For example, the section can be set so that red light is emitted in the state of being only one step away from, winning the game, and yellow light is emitted in the state where the bingo line is completed.

<As for Bet Target>

FIG. 6 is an illustration showing one example of a game image which is displayed on the display section 42.

In this game image, 6 kinds (CARD 1 to CARD 6) of bingo cards 60 to be a bet target are displayed. Each bingo card 60 is framed by a square shaped frame region distinguishably from other cards, and has symbols which are arranged corresponding to respective cells arranged in a matrix of 3 rows and 5 columns. Note that the bingo card is not limited to the 3-by-5 cell matrix, but may have a configuration using the bingo card with cells of M rows (M is an integer equal to or larger than 2) and N columns (N is an integer equal to or larger than 2), where M and N may be a same integer, not different integers. Also, the number of the kinds of the bingo cards are not limited to 6 but may be larger than 6.

Also, the bingo card 60 displays the symbols arranged on the first row which are ones arbitrarily selected and allocated from the symbols determined by the lottery draw in the first roulette wheel 11. Also, ones selected from the symbols determined by the lottery draw in the second roulette wheel 12 are allocated as the symbols arranged on the second row. Also, ones selected from the symbols determined by the lottery draw in the third roulette wheel 13 are allocated as the symbols arranged on the third row. Accordingly, one roulette wheel is associated with each raw (see FIG. 7A).

Here, identification information to distinguish from others is preset in each roulette wheel. Specifically, since color information is set as identification information, when each of R, G, and B is 8-bit color information, the first roulette wheel 11 is associated with red (R, G, B=255, 0, 0), the second roulette wheel 12 is associated with blue (R, G, B=0, 0, 255), and the third roulette wheel 13 is associated with green (R, G, B=0, 255, 0), which are then stored in the memory. Note that, as described above, the roulette wheels are designed in different colors, so that a player can easily visually identify each roulette wheel.

Accordingly, if a winning symbol determined by the lottery draw in the roulette wheel matches the symbol arranged on the bingo card, the identification information can be utilized when a mark (a label) is given to the symbol and the bingo card is displayed.

For example, as shown in FIG. 6, the symbols "1" and "13" on the first row of the bingo card CARD 1 are displayed with x check-marks. At this time, the symbols "1" and "13" are winning symbols determined by the lottery draws in the first roulette wheel 11. Thus, based on the color information associated with the first roulette wheel 11, the bingo card can be displayed with the symbol being covered by the "x" mark in red. Also, the symbols "17" and "89" are winning symbols determined by the lottery draws in the second roulette wheel 12. Thus, based on the color information associated with the second roulette wheel 12, the bingo card can be displayed with the symbol being covered by the "x" mark in blue.

Also, as shown in FIG. 6, a betting button 61 is displayed corresponding to each of the bingo cards (CARD 1 to CARD 6). The player can add the amount of betting game values one by one every time the player touches the betting button 61 corresponding to a desired bingo card. Note that the example of the illustrated game image shows a state where 10 points (10 dollars) are bet as an amount of the game values for each of the bingo cards (CARD1 to CARD6).

Displayed on the left side of the game screen are a region 65*a* showing the symbol determined by the lottery draw (the winning symbol) in the first roulette wheel 11, a region 65*b* showing the winning symbol of the second roulette wheel 12, and a region 65*c* showing the winning symbol of the third roulette wheel 13. In other words, every time the ball enters the pocket in each roulette wheel, the display of the winning symbol is increased in the regions 65*a* to 65*c* corresponding to the respective roulette wheels.

Displayed on the right side of the game screen are a region 66*a* showing a payout condition (a pay line) in the progressive lottery game, a region 66*b* showing a payout condition (a pay line) in the normal lottery game, a button 67 for selecting a double up game which can double the amount of the game values obtained in the bingo game, a display region 68 showing that an extra ball is supplied in the third stage in the lottery mode to be described later, and a switching button 69 for switching the screen display of other gambling games (for example, keno) which progresses in parallel with the bingo game.

Here, the progressive means the following functions: to accumulate a certain percentage of the amount of the medals or tokens for play or cash bet by a plurality of players every when the players bet the medals, etc; and to pay at one time to the players who satisfies the predetermined conditions in the game, a bonus equivalent of the amount of the accumulated medals, etc or a bonus equivalent of one part of the amount of the accumulated medals, etc.

Accordingly, the player can specially obtain a big dividend which cannot be normally obtained in the game.

Displayed on the lower side of the game image are a WIN 62 which is a region showing a total amount of the prize game values, a BET 63 which is a region showing the total amount of the game values bet on all the bingo cards, and a CREDITS 64 which is a region showing the amount of the credited game values.

<As for Payout Condition>

FIG. 8 is a table illustrating one example of payout conditions in the progressive lottery. The payout condition determines an arrangement of symbols which is to "win" as a result of a lottery, and is referred to as a pay line. When an amount of game values that a player can obtain is preset for each pay line and any of the pay lines is completed in a bingo card, in other words, when the payout condition is fulfilled, the amount of game values according to the completed pay line is distributed to the player as a prize.

Specifically, in the first stage of the lottery mode to be described later, the progressive lottery is executed. And, there is set up the payout conditions for the progressive lottery, in other words, the pay line and an amount of game values which is paid out when the conditions are established, as shown in FIGS. 8A to 8C.

FIG. 8A shows a bingo card when the payout condition of SECOND JACKPOT is fulfilled. The SECOND JACKPOT means that as a result of the progressive lottery in the first stage to be described later, all symbols included in any two of the three rows match the winning symbols of the first stage. It is set that when the payout condition is fulfilled, a bonus equivalent of one portion of the amount of the stored game values is paid as a prize (for example, 700.00 points (dollars)).

FIG. 8B shows a bingo card when the payout condition of BINGO JACKPOT is fulfilled. The BINGO JACKPOT means that as a result of the progressive lottery in the first stage to be described later, bingo is completed in all the three rows, in other words, all symbols included in the three rows match the winning symbols of the first stage. It is set that when the payout condition is fulfilled, a bonus equivalent of the amount of the stored game values is paid as a prize (for example, 12,300.00 points (dollars)) (see, FIG. 6).

FIG. 8C is an illustration showing one example of payout conditions (for the progressive lottery) which are stored in a predetermined memory region in the storage section 36.

A cell number is given to each cell of the bingo card and one-bit flag information is stored with respect to each cell number. When a winning symbol is determined by a lottery draw in a roulette wheel, a value of "1" is stored in the cell number of the bingo card having the symbol matching the winning symbol. When no match is found, a value of "0 (NULL)" is stored. Flagging in this manner corresponds, in a case of an actual bingo card, to opening a cell in which a winning number is present and thereby indicating that the number is activated.

As shown in FIG. 8C, SECOND JACKPOT (UP) means that the payout condition is fulfilled when flags are on at least for the cell numbers 1 to 10. The BINGO JACKPOT (JP) means that the payout condition is fulfilled when flags are on for all the cell numbers.

FIG. 9 is a table illustrating one example of payout conditions in a normal lottery. In the second and third stages of the lottery mode to be described later, the normal lottery is executed. As shown in FIGS. 9A to 9C, there are set up the payout conditions for the normal lottery, in other words, the pay line and an amount of game values which is paid out when the conditions are established.

FIG. 9A shows a bingo card when the payout condition of a LINE is fulfilled. The LINE means that as a result of the lottery, all symbols included in any one of three rows match the winning symbols. Then, it is set that a 4 times larger amount of bet game values is paid as a prize when the payout condition is fulfilled.

FIG. 9B shows a bingo card when the payout condition of a V is fulfilled. The V means that as a result of the lottery, symbols in a V-shaped arrangement match the winning symbols. Then, it is set that a 2 times larger amount of bet game values is paid as a prize when the payout condition is fulfilled.

FIG. 9C shows a bingo card when the payout condition of a T is fulfilled. The T means that as a result of the lottery, symbols in a T-shaped arrangement match the winning symbols. Then, it is set that a 10 times larger amount of bet game values is paid as a prize when the payout condition is fulfilled.

FIG. 9D shows a bingo card when the payout condition of a BINGO is fulfilled. The BINGO means that as a result of the lottery, all symbols in three rows match the winning symbols. Then, it is set that a 1000 times larger amount of bet game values is paid as a prize when the payout condition is fulfilled.

FIG. 9E shows a bingo card when the payout condition of a DOUBLE LINE is fulfilled. The DOUBLE LINE means that as a result of the lottery, all symbols in any two of the three rows match the winning symbols. Then, it is set that a 100 times larger amount of bet game values is paid as a prize when the payout condition is fulfilled.

FIG. 9F shows a bingo card when the payout condition of a LARGE SQUARE is fulfilled. The LARGE SQUARE means that as a result of the lottery, symbols arranged in four corners match the winning symbols. Then, it is set that a 200 times larger amount of bet game values is paid as a prize when the payout condition is fulfilled.

FIG. 9G is an illustration showing one example of payout conditions (for the normal lottery) which are stored in a predetermined memory region in the storage section 36.

As for the LINE, the payout condition is fulfilled when flags are on at least for the cell numbers 6 to 10. As for the V, the payout condition is fulfilled when flags are on at least for the cell numbers 1, 5, 7, 9, and 13. As for the T, the payout condition is fulfilled when flags are on at least for the cell, numbers 1 to 5, 8, and 13. As for the BINGO, the payout condition is fulfilled when flags are on for all the cell numbers. As for the DOUBLE LINE, the payout condition is fulfilled when flags are on at least for the cell numbers 1 to 10. As for the LARGE SQUARE, the payout condition is fulfilled when flags are on at least for the cell numbers 1 to 6 and 10 to 15.

Note that there is a possibility that two or more of a plurality of the payout conditions are fulfilled at the same time. Therefore, it is set that, in such a case, there is paid as a prize a total amount of the game values to be obtained as a result of the establishment of the plurality of conditions.

<As for Outline of Game>

Figure 10:
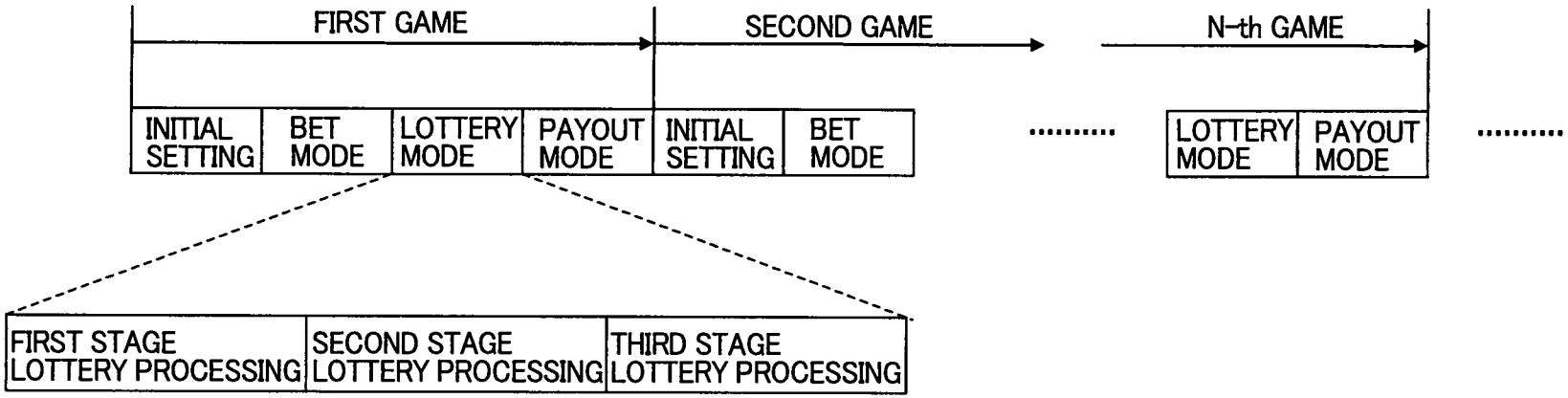
FIG. 10 is a chart showing a cycle of progress in a game.

According to FIG. 10, game processing of the bingo game in the present embodiment is described. The game processing of the present embodiment is executed based on a game program which has a sequence of an initial setting, a bet mode, a lottery mode, and a payout mode as one set. Then, the bingo game is repeatedly played by repeating this sequence. In each mode, the game processing in the lottery apparatus 10 and the game processing in the player terminal device 20 are progressing while interacting each other.

The lottery processing in the lottery mode is performed in three stages of the first stage, the second stage, and the third stage, and the winning symbols are determined in stages by the lottery draws.

In the first stage which is performed first, 12 balls are supplied to each roulette wheel, and 36 winning symbols are determined in total by the lottery draws. In this first stage, since the progressive lottery draw is performed, it is determined whether the payout conditions shown by the bingo card in FIG. 8 are fulfilled or not. For this reason, the player can obtain a large amount of game values accumulated for the progressive as a bonus when the bingo is completed in the lottery draw of the first stage.

Thereby, the progressive lottery draw is performed first each time, so that the player can have a chance to obtain a high dividend frequently.

Accordingly, this can solve a conventional problem of lacking in game persistency which is caused by losing in its early stages a sense of anticipation to be capable of obtaining a high dividend by the progressive.

In the following second stage, 3 balls are supplied to each roulette wheel, and 9 winning symbols are determined in total by the lottery draws. In this second stage, since the normal lottery draw is performed, it is determined whether the payout conditions shown by the bingo card in FIG. 9 are fulfilled or not.

In the last third stage, a normal lottery draw is performed by extra balls. In this third stage, the control section 20 in the lottery apparatus determines at random whether the lottery by an extra ball is performed. This can increase a sense of anticipation of a player who thought that the lottery has already finished in the second stage. For example, if a player is only one step away from winning when the second stage finishes, the lottery draw of the third, stage suddenly starts. In this case, a desired symbol may come out to complete the bingo.

Note that in the third stage in the present embodiment, one extra ball is supplied to each roulette wheel. However, a plurality of extra balls may be supplied.

<As for Operation>

Figure 11:
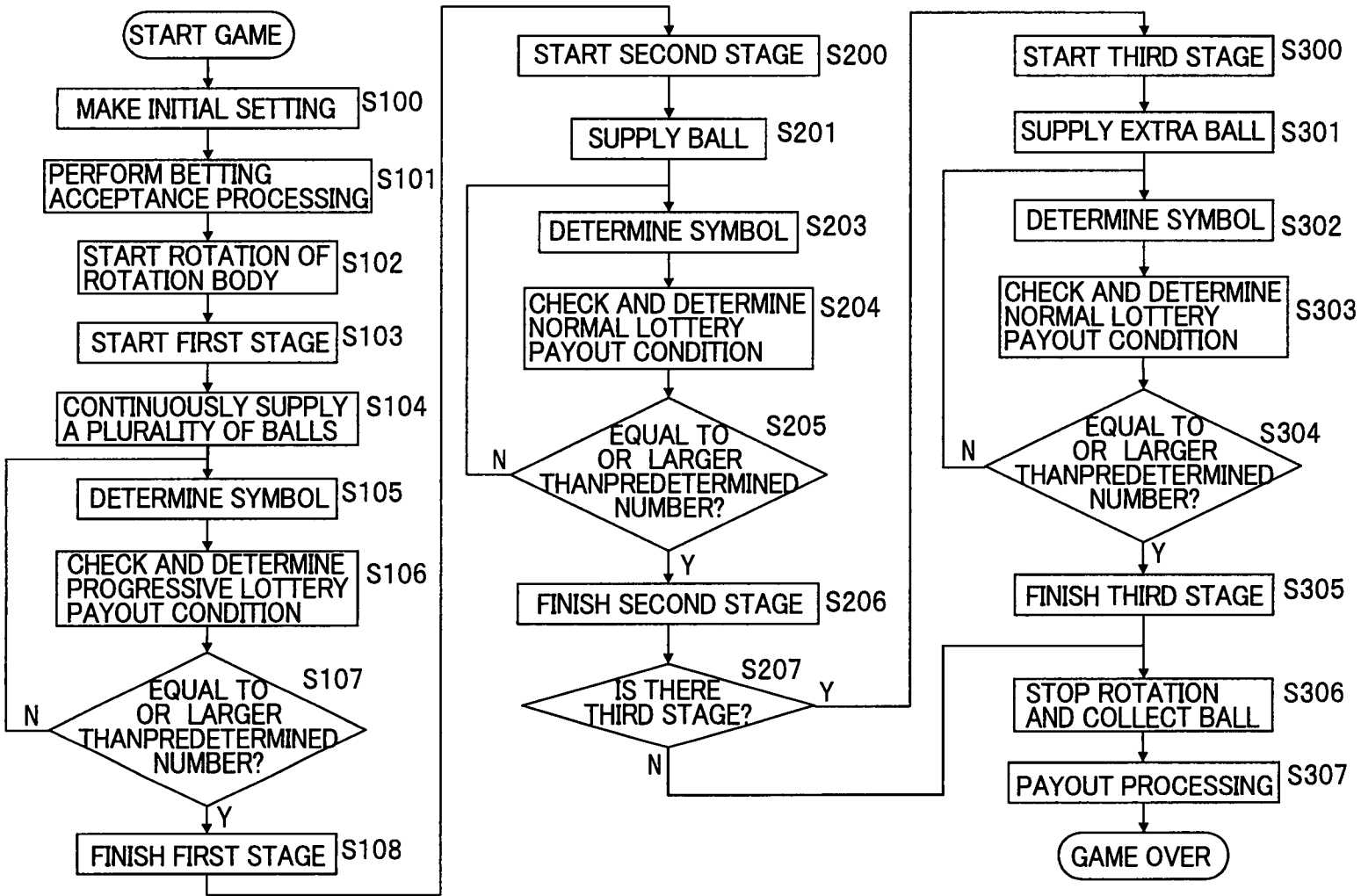
FIG. 11 is a flowchart showing an example of processing in the game system.

FIG. 11 shows a flowchart illustrating an operation of the bingo game system in the present embodiment.

<Initial Setting Processing>

First, an initial setting of a game system is performed (step S100). Specifically, in the lottery apparatus 10, the control section 20 determines whether the lottery processing in the third stage is executed. In the player terminal device 30, the arrangement-determination section 32 determines symbols to be arranged in each cell of the 6 kinds of the bingo cards. Reset of each piece of information which is stored in RAM is also performed.

<Betting Acceptance Processing>

The game system starts a bet mode after the initial setting is completed (S101). The control section 20 in the lottery apparatus measures time until an acceptance time to accept betting has past. As the acceptance time, a certain time (for example, 30 seconds) is predetermined. It is designed that this predetermined time is measured by a timer which is included in the control section 20 (not shown). It is important in this type of multi-player game system to raise operation rates of the game by shortening the play time of one cycle (1 game) as much as possible. In some cases, as a product quality, how many times a player can play one cycle of the game per unit time is focused. Thus, it is also possible that the timer can be set so as to have a plurality of timings by an operator of a shop using a setting input interface (not shown) coupled to the control section 20.

When receiving a switching signal which is transmitted from the lottery apparatus 10, the initial setting mode is switched to the bet mode, and the player terminal device 30 accepts the betting operation of the player.

In the player terminal device 30, the game image including the 6 kinds of bingo cards is created based on the arrangement of the symbols determined by the arrangement-determination section 32. And, the 6 kinds of bingo cards are displayed on the display section 42. In each bingo card, numbers, that is symbols, are respectively arranged in cells of 3 rows and 5 columns. Comparing the 6 kinds of bingo cards, the player selects any one or more cards among them, and bets a desired amount of game values by operating the touch panel. This betting operation can be made until the acceptance time has passed.

When the betting operation is finished, the acceptance section 34 subtracts an amount of the bet game values from the credit data which is the amount of game values input by the value input section and is stored in the storage section 36, and then updates the credit data.

Also, information on the amount of game values which are bet by the player in each player terminal device is transmitted from the communication section 37 of each player terminal device to the lottery apparatus 10 via the network. Based on the received information on the amount of the bet game values, the control section 20 in the lottery apparatus 10 accumulates a several percent of the total amount of the bet game values as a resource to be paid as a bonus of the progressive lottery at the time of the payout mode to be described later, and stores the amount in the storage section 19 as resource data.

<Lottery Processing>

The game system performs switching to the lottery mode when the bet mode is finished. Under the control of the control section 20 in the lottery apparatus 10, each roulette wheel starts rotating in one direction (S102).

In the lottery mode, the lottery processing in the first stage starts first (S103). When the first stage starts, under the control of the control section 20 in the lottery apparatus 10, the supply section 14 supplies each roulette wheel with a plurality of balls (12 balls) continuously (S104). Note that, the balls are not necessarily supplied continuously. A following ball may be supplied after the sensor confirmed that the previous ball entered a pocket.

Here, the control section 20 is configured to control supply of balls independently to each roulette wheel when a ball is supplied to each roulette wheel by activating the supply section 14.

Without the individual control in this manner, when a mechanical error, etc occurs, the intensity of the ball movement is different between the roulette wheels, which results in failing to keep fairness of the lottery. For this reason, the independent control can avoid the foregoing problem. This effective control can be achieved because three roulette wheels are used.

Also, the independent control can give more dramatic impact to a player than ever before. For example, when an extra ball to be described later is supplied to the roulette wheels, a sense of anticipation can be raised by a process in which the three roulette wheels are controlled so that the ball is discharged onto a roulette wheel desired to be focused after the balls are discharged onto the other roulette wheels.

In this manner, as compared with the case where 36 balls are supplied to one roulette wheel, supplying 12 balls to each of the three roulette wheels makes it easy to control rotation speeds of the roulette wheels. This is because a frequency of collisions between the balls decreases. Also, this can avoid the phenomenon in which the balls are gathered in a specific region on the roulette wheel and the balls tend to enter pockets in the region.

In each roulette wheel, when any of the 12 balls enters any of the 30 pockets, the entering is detected by a sensor provided in the pocket. When receiving the detection signal transmitted from the sensor, the control section 20 in the lottery apparatus 10 identifies a sensor number (a pocket number) and determines a corresponding symbol to the sensor number (the pocket number) based on the table data stored in the storage section 19 (S105).

The determined symbols become winning symbols; the winning symbols and the sequence that are determined as the winning symbols are stored in RAM. Then, the control section 20 in the lottery apparatus 10 transmits the winning symbols (code numbers of the winning numbers) to each player terminal device from the communication section 18 via the network every when the winning symbol is determined. In the first stage, since 12 symbols are determined by the lottery draws in each roulette wheel, the lottery draws are repeated until 36 symbols are determined in total.

The player terminal device 30 stores the winning symbols in RAM in sequence as the winning symbols have been received (sequence of winning) every when the winning symbol (the code number of the winning number) is received. The determination section 33 compares the winning symbols with the symbols arranged on the bingo card and judges whether a matched symbol is present. When the matched symbol is present, a flag is on in the cell number in which the symbol is allocated. Then, in the progressive lottery draw which is performed in the first stage, comparison is made based on the flag information with the pay line shown in FIG. 8C (progressive lottery payout conditions) to judge whether the bingo line is completed (S106). When the bingo line is completed, the control section 31 in the player terminal device stores a kind of the completed bingo line (such as BINGO JACKPOT) in RAM as the lottery result information. Also, under the control of the control section 31 in the player terminal device, the light-emitting section 45 is caused to emit light in a predetermined color in a blinking manner to produce the dramatic impact.

This series of operations is repeated a predetermined times (S107). In other words, the lottery draws repeatedly take place until the 12 winning symbols are determined for each roulette wheel, and when the 36 symbols are determined in total, the first stage is finished (S108).

When the first stage is finished, the lottery processing in the second stage starts (S200). When the second stage starts, under the control of the control section 20 in the lottery apparatus 10, the supply section 14 supplies each roulette wheel with a plurality of balls (3 balls) (S201).

In each roulette wheel, when any of the 3 balls enters any of the 30 pockets, the entering is detected by a sensor provided in the pocket. When receiving the detection signal transmitted from the sensor, the control section 20 in the lottery apparatus 10 identifies a sensor number (a pocket number) and determines a corresponding symbol to the sensor number (the pocket number) based on the table data stored in the storage section 19 (S203). The determined symbols become winning symbols; the winning symbols and the sequence that are determined as the winning symbols are stored in RAM. Then, the control section 20 in the lottery apparatus 10 transmits the winning symbols (code numbers of the winning numbers) to each player terminal device from the communication section 18 via the network every when the winning symbol is determined. In the second stage, since 3 symbols are determined by the lottery draws in each roulette wheel, the lottery draws are repeated until 9 symbols are determined in total.

The player terminal device 30 stores the winning symbols in RAM in sequence as the winning symbols have been received (sequence of winning) every when the winning symbol (the code number of the winning number) is received. The determination section 33 compares the winning symbols with the symbols arranged on the bingo card and judges whether a matched symbol is present. When the matched symbol is present, a flag is on in the cell number in which the symbol is allocated. Then, in the normal lottery draw which is performed in the second stage, comparison is made based on the flag information with the pay line shown in FIG. 9G (normal lottery payout conditions) to judge whether the bingo line is completed (S204). When the bingo line is completed, the control section 31 in the player terminal device stores a kind of the completed bingo line (such as LINE or V) in RAM as the lottery result information. Also, the light-emitting section 45 creates a dramatic impact.

This series of operations is repeated for a predetermined time (S205). In other words, the lottery draws repeatedly take place until the 3 winning symbols are determined for each roulette wheel, and when the 9 symbols are determined in total, the second stage is finished (S206).

When the second stage is finished, the lottery processing in the third stage is started (S300) if to proceed to the third stage is determined in the initial setting stage (S207). When the lottery processing in the third stage is not performed (S207), the step proceeds to S306 to be described later.

When the third stage starts, under the control of the control section 20 in the lottery apparatus 10, the supply section 14 supplies each roulette wheel with an extra ball (1 ball) (S301). Note that a plurality of extra balls may be supplied. Also, it is possible that any one of the three roulette wheels is selected to supply only the roulette wheel with the extra ball.

In each roulette wheel, when the extra ball enters any of the 30 pockets, the entering is detected by the sensor provided in the pocket. When receiving the detection signal transmitted from the sensor, the control section 20 in the lottery apparatus 10 identifies a sensor number (a pocket number) and determines a corresponding symbol to the sensor number (the pocket number) based on the table data stored in the storage section 19 (S302). The determined symbols become winning symbols; the winning symbols and the sequence that are determined as the winning symbols are stored in RAM. Then, the control, section 20 in the lottery apparatus 10 transmits the winning symbols (code numbers of the winning numbers) to each player terminal device from the communication section 18 via the network every when the winning symbol is determined. In the third stage, since one symbol is determined by the lottery draws in each roulette wheel, the lottery draws are repeated until 3 symbols are determined in total.

The player terminal device 30 stores the winning symbols in RAM in sequence as the winning symbols have been received (sequence of winning) every when the winning symbol (the code number of the winning number) is received. The determination section 33 compares the winning symbols with the symbols arranged on the bingo card and judges whether a matched symbol is present. When the matched symbol is present a flag is on in the cell number in which the symbol is allocated. Then, in the normal lottery draw which is performed in the third stage, comparison is made based on the flag information with the pay line shown in FIG. 9G (normal lottery payout conditions) to judge whether the bingo line is completed (S303). When the bingo line is completed, the control section 31 in the player terminal device stores a kind of the completed bingo line in RAM as the lottery result information. Also, the light-emitting section 45 creates a dramatic impact.

This series of operations is repeated for a predetermined time (S304). In other words, the lottery draws repeatedly take place until the 1 winning symbol is determined for each roulette wheel, and when the 9 symbols are determined in total, the third stage is finished (S305).

When the third stage is finished, under the control of the control section 20 in the lottery apparatus 10, the rotation of each roulette wheel stops, and the collecting section 17 collects the balls held in each pocket of each roulette wheel (S306).

<Payout Processing>

The game system performs switching to the payout mode when the lottery mode is finished. When receiving a switching signal which is transmitted from the lottery apparatus 10, the player terminal device 30 performs switching from the lottery mode to the payout mode to perform payout processing (S307).

When the payout mode starts, based on the lottery result information at the time of finishing the lottery mode which is stored in RAM, the payout section 35 in the player terminal device 30 calculates a total amount of game values that the player obtains as a prize through the bingo game. Then the calculated amount of game values is added to the credit data which has been already stored in the storage section 36, so that the payout to the player is completed.

Other Embodiments

The bingo game system is described as one embodiment. However, the above-described embodiment is intended to facilitate understanding of the present invention and is not intended to be limitedly translated. It is of course natural that the present invention is modified or improved, and includes equivalents thereof without, departing from the scope thereof. In particular, the following embodiments are also included in the present invention.

<Multi-Game>

In the above-described embodiment, an example in which the bingo game is employed as a game system of the present invention is described. However, the present invention may be applied as a multi-game in which a bingo game and a keno game are played together.

That is, the following game system may also be employed: displaying on the display section 42 a game image including a bingo card and a keno card, the bingo card having numbers which are arranged at random, in a matrix of 3 rows and 5 columns, the keno card having numbers which are arranged regularly in a matrix of 5 rows and 6 columns; comparing winning numbers of lottery draws with the numbers arranges in each card, the lottery draws being performed by three roulette wheels in the lottery apparatus 10; and giving to a player as a prize game values which are obtained based on the completed bingo row or the matched numbers.

Also, as for the game image which is displayed on the display section 42, by operating the switching button 69 through a touch panel, a player may switch the game image including 6 kinds of bingo cards to the game image including 3 kinds of keno cards, the bingo cards image having numbers which are arranged at random in a matrix of 3 rows and 5 columns, the keno cards image having numbers which are arranged regularly in a matrix of 5 rows and 6 columns matrix, as shown in FIG. 6.

Note that the number of kinds of keno cards matches the number of rotation bodies. Thus, 3 kinds of cards are displayed. Also, since each kind of keno cards is associated with any of the rotation bodies, any one of symbols (30 symbols) associated with the rotation body is arranged in each cell of the keno card.

Also, the keno card is not limited to have the matrix of 5 rows and 6 columns and the number of the kinds of keno card is not limited to three. The same holds true for the bingo card. Also, the game system of the present invention is not limited to the multi-game. It is possible that only keno is applied.

<Double-Up Game>

Also, the bingo game system as one embodiment may play a double-up game after determining the amount of game values that the player will be obtained as a prize through the bingo game.

The double-up game means a game in which the prize game values are bet when the player wins the game values in the bingo game as a prize. In this game, comparing a number of a card which is selected by the control section 31 with a number of one card that the player had selected, one who selected a card with a larger number wins. The card selected by the section 31 is selected at random through the control of the control section 31 in the player terminal device. The card selected by the player is selected out of a plurality of the cards through the touch panel with the card being turned over. When the player wins, the amount of game values obtained in the bingo game is doubled, while when the player loses, the amount of game values are all taken.

As for the double-up game, if the double-up game processing is executed, by the control section 20 in the lottery apparatus 10 is determined at the time of the initial setting. Note that the double-up game may be set to be performed every single game.

When playing the double-up game, the player operates a button 67 (see, FIG. 6) through the touch panel. The control section 31 in the game terminal determines that the button 67 is operated through the touch panel. When the button 67 is operated, the double-up game processing is performed to determine whether the player wins. When the player won, the processing to double the amount of the prize game values is performed. Then, the control section 31 in the player terminal device looks up to the information of the game values obtained in the bingo game which is stored in RAM and updates the original information by doubling the stored amount.

When the player has not operated the button 67 (see, FIG. 6) through the touch panel during a predetermined period of time, the double-up game is not played. Thus, the amount of game values obtained in the bingo game is added to the credit data which has been already stored in the storage section 36. Then, the payout to the player is completed.

<Others>

The player terminal device 30 in the above-described embodiment is not limited to one which is operated as one part of a business-use game apparatus which is installed in premises or an amusement facility. It may be similarly applied to a home-use game apparatus, a potable game apparatus, or other computers.

Also, in the above-described game system, the example is described that a multiple-player game apparatus is used, in which up to 9 players may be participated at the same time. However, a game apparatus in which only one player plays may be used.

Also, there may be achieved the bingo game as follows: a plurality of bingo game apparatuses are coupled with one another through a network and the plurality of bingo game apparatuses each perform a bingo game which use the same lottery result devices.

Also, the present invention may have the following configuration.

A random number determination device for a gaming machine, the gaming machine including: a plurality of rotatable rotation bodies having a plurality of pockets; a supply section that supplies each rotation body with a plurality of lottery bodies from a corresponding snoot port (a supplying port) to each rotation body; a detection section that detects that the lottery body supplied to each rotation body enters a pocket; a storage section storing a program of a random-number-determination game which is played when the lottery body enters the pocket in each rotation body; and a control section that controls a progress of the random-number-determination game based on the program, wherein each rotation body is configured independently so that a lottery body supplied to the rotation body is prevented from going back and forth between the rotation bodies, numbers are allocated in a manner that numbers which correspond, respectively to the plurality of pockets provided in one of the plurality of rotation bodies do not overlap numbers which corresponds respectively to the plurality of pockets provided in another rotation body, and the control section controls supply of a plurality of lottery bodies to each rotation body by the supply section though each shoot, port and performs a lottery draw to determine numbers corresponding to the pockets based on a detection signal transmitted from the detection section every when any one of the lottery bodies of each rotation body enters any of the pockets.

This configuration can avoid a monotonous lottery process in which 36 numbers determined simply by a computer operation or the like are displayed at random. That is, a plurality of numbers (36 numbers with 36 balls) can be determined at random in a short time while a player can visually recognize a lottery process in which the numbers are determined at once by supplying three roulette wheels with a plurality of balls. The method in which numbers (symbols) are determined at random while showing the lottery process is useful when applied to a gaming machine whose users have high awareness for cheating.

REFERENCE SIGNS LIST

1 game system, 10 lottery apparatus,

11 first rotation body (first roulette wheel),

12 second rotation body (second roulette wheel),

13 third rotation body (third roulette wheel),

14 supply section, 15 rotation section, 16 detection section, 19 storage section,

20 control section, 30 player terminal device, 31 control section,

32 arrangement-determination section, 33 determination section, 34 acceptance section,

35 payout section, 36 storage section, 40 betting operation section,

41 image creation section, 42 display section

The invention claimed is:

1. A game system comprising:

a plurality of player terminal devices; and a lottery apparatus coupled to the plurality of player terminal devices in a manner capable of information communication, wherein the lottery apparatus comprises:

a plurality of rotatable rotation bodies having a plurality of pockets, a supply section supplying each rotation body with a lottery body, a detection section detecting entering of the lottery body into a pocket, the lottery body being supplied to the rotation body, a storage section storing a program of a lottery game that is performed by causing the lottery body to enter the pocket, and a control section controlling a progress of the lottery game based on the program, the player terminal device comprises:

a display section displaying a game image including a bet target formed of a combination of a plurality of symbols, an acceptance section accepting an input of a game value, and a betting operation section through which a player bets the game value on the bet target, the bet target is set as a card in which a symbol is allocated to each of a plurality of cells arranged in a matrix form consisting of M rows and N columns, wherein M and N are integers equal to or larger than 2, wherein the number of the rotation bodies provided are equal to the number of either one of the rows M and the columns N of the card, and each rotation body corresponds to each respective row or column, wherein the symbols are allocated in a manner that symbols respectively corresponding to the plurality of pockets provided in one of the plurality of rotation bodies do not repeat symbols respectively corresponding to the plurality of pockets provided in any other rotation body, wherein the control section:

controls supply of the lottery body to each rotation body by the supply section, and performs a lottery draw by determining a corresponding symbol to the pocket, based on a detection signal transmitted from the detection section, when each lottery body of each rotation body enters any of the pockets, and the player terminal device further comprises:

an arrangement-determination section that sets an arrangement of the symbols allocated in the cells included in each row or column of the card such that each of the allocated symbols is the same as any of the symbols to be determined by the lottery draw in the corresponding rotation body to the respective row or column.

2. The game system according to claim 1, wherein the player terminal device further comprises:

a payout section that pays a prize game value and a determination section determining, based on a result of the lottery game, whether a player obtains a prize game value, the program of the lottery game includes a bet mode, a lottery mode, and a payout mode, in the bet mode:

the control section accumulates a part of a total amount of the game value as an amount of resource to pay out in the payout mode, the game value being bet by a player who operates the player terminal device, and the control section stores the accumulated value as resource data in the storage section, the lottery mode is preset so that a lottery result is determined by performing the lottery draw in a plurality of stages, in a first stage in which a first lottery draw is performed, the control section controls supply of a plurality of the lottery bodies to each rotation body by the supply section, and the control section determines a corresponding symbol to the pocket based on a detection signal transmitted from the detection section, when each lottery body of each rotation body enters any of the pockets, the determination section determines whether a predetermined payout condition is fulfilled by comparing the determined symbol with the symbols arranged in the card, and in the payout mode, when the payout condition is fulfilled, the payout section controls paying of an amount of the game value which is subtracted from the resource value corresponding to the resource data.

3. The game system according to claim 2, wherein the plurality of stages includes a second stage and a third stage in each of which the lottery draw is performed after the first stage, before the lottery draw of the first stage, the control section determines whether the lottery draw is performed in the third stage, in the second stage which takes place after the lottery draw of the first stage is finished, the control section controls supply of a smaller number of the lottery bodies to each rotation, body by the supply section than the number of the lottery bodies supplied in the first stage, and the control section determines a corresponding symbol to the pocket based on a detection signal transmitted from the detection section, when each lottery body in each rotation body enters any of the pockets, and when it is determined that the lottery draw is performed in the third stage after the lottery draw of the second stage is finished, the control section controls supply of a single lottery body to each rotation body by the supply section, and the control section controls determining a corresponding symbol to the pocket based on a detection signal transmitted from the detection section, when the lottery body in each rotation body enters any of the pockets.

4. The game system according to claim 1, wherein identification information is set for each of the rotation bodies, and the game system further comprises an image creation section creating a game image when the symbol is determined by the lottery draw in one of the plurality of rotation bodies, the game image including a card in which a label corresponding to the identification information of the one rotation body is added to a cell to which the determined symbol is allocated.

5. A game apparatus comprising:

a plurality of rotatable rotation bodies having a plurality of pockets;

a supply section that supplies each rotation body with a lottery body;

a detection section that detects entering of the lottery body into a pocket, the lottery body being supplied to the rotation body;

a storage section storing a program of a lottery game that is performed by causing the lottery body to enter the pocket;

a control section that controls a progress of the lottery game based on the program;

a display section that displays a game image including a bet target formed of a combination of a plurality of symbols;

an acceptance section that accepts an input of a game value; and a betting operation section through which a player bets the game value on the bet target, wherein the bet target is set as a card in which a symbol is allocated to each of a plurality of cells arranged in a matrix form consisting of M rows and N columns, wherein M and N are integers equal to or larger than 2, the number of the rotation bodies provided are equal to the number of either one of the rows M and the columns N of the card, and each rotation body corresponds to each respective row or column, the symbols are allocated in a manner that symbols respectively corresponding to the plurality of pockets provided in one of the plurality of rotation bodies do not repeat symbols respectively corresponding to the plurality of pockets provided in any other rotation body, wherein the control section controls supply of the lottery body to each rotation body by the supply section, and performs a lottery draw by determining a corresponding symbol to the pocket based on a detection signal transmitted from the detection section, when each lottery body of each rotation body enters any of the pockets, and wherein the game apparatus further comprises an arrangement-determination section that sets an arrangement of the symbols allocated in the cells included in each row or column of the card such that each of the allocated symbols is the same as any of the symbols to be determined by the lottery draw in the corresponding rotation body to the respective row or column.

* * * * *